United States Patent [19]

Weihe

[11] Patent Number: 4,473,922

[45] Date of Patent: Oct. 2, 1984

[54] TRAY DRYER

[76] Inventor: Clyde R. Weihe, 17 Lindberg Ave., Needham Heights, Mass. 02194

[21] Appl. No.: 437,877

[22] Filed: Oct. 29, 1982

[51] Int. Cl.[3] ..... A47L 5/38

[52] U.S. Cl. ..... 15/306 B; 15/316 R; 414/32; 414/99; 414/121

[58] Field of Search ..... 15/306 B, 308, 306 R, 15/306 A, 316 R; 414/32, 86, 99, 121

[56] References Cited

U.S. PATENT DOCUMENTS

| | | | |
|---|---|---|---|
| 2,255,615 | 9/1941 | Frankel | 15/306 B X |
| 3,117,333 | 1/1964 | Murray et al. | 15/308 X |
| 3,123,218 | 3/1964 | Bronson | 414/99 X |
| 3,574,526 | 4/1971 | Bell | 15/308 X |
| 3,805,316 | 4/1974 | Sheppard | 15/306 B |
| 3,849,831 | 11/1974 | DeVerter et al. | 15/306 B X |
| 4,002,332 | 1/1977 | Hoenigmann | 414/121 X |
| 4,044,420 | 8/1977 | Hanson | 15/306 B X |
| 4,129,919 | 12/1978 | Fitch et al. | 15/308 X |

*Primary Examiner*—Chris K. Moore

*Attorney, Agent, or Firm*—Herbert L. Gatewood

[57] ABSTRACT

Apparatus is provided which accomplishes the drying of wet cafeteria or the like trays without benefit of heat and with low energy consumption. Wet trays are presented to the apparatus and conveyed through it one-at-a-time, bottom side up, and in such a manner that the leading side edge of the wet tray is at an angle less than normal to the tray's direction of travel. The wet tray while passing through the apparatus is subjected, top and bottom, to high velocity air which strips the water from the tray, the water being then discharged from the system.

24 Claims, 10 Drawing Figures

TRAY DRYER

BACKGROUND OF THE INVENTION

1. Field of the Invention

This invention relates in general to a drying apparatus, more particularly to an apparatus for drying wet serving trays such as are used in cafeterias and hospitals, to apparatus for feeding wet trays from a stack thereof to the drying apparatus, and for stacking dry trays.

2. Description of the Prior Art

The cafeteria style restaurant is commonly found in, among other places, manufacturing plants, office buildings, schools and hospitals. In such a restaurant the patron commonly first takes a serving tray from a stack of trays and proceeds along a serving line, selecting that food which is desired to be eaten.

A common complaint by cafeteria patrons is that the serving tray is usually wet, having been inadequately dried after washing, or in some cases not even dried at all, except as can be accomplished by air while standing awaiting use. In either case drying of cafeteria trays has been found less than satisfactory. Where drying is accomplished by dryers conventionally used heretofore, the capital cost of such dryers is high, yet ordinarily results in less than satisfactorily dried trays. In addition to limited effectiveness, existing tray dryers use substantial amounts of energy. Trays left to dry in the standing air do not dry, as trays are ordinarily stacked while not being used, one on top of the other.

SUMMARY OF THE INVENTION

There is provided in accordance with the basic aspects of my invention a dryer for serving trays which comprises:

Apparatus for the drying of wet serving trays without benefit of heat comprising:

(a) means for conveying said wet trays horizonally, bottom side up, one-at-a-time through said apparatus in a predetermined path;

(b) means for subjecting the top and bottom of each said tray while being so conveyed to high velocity air for wiping or stripping the water from the tray; and (c) means for collecting the water so removed for disposal as desired.

Quite advantageously the wet trays are dried without need for heat and with relatively low energy consumption.

In the more preferred aspect of the invention, apparatus are provided in combination with the drying apparatus for feeding trays one-at-a-time from a stack of wet trays to the drying apparatus and for collecting the dry trays discharged from the drying apparatus and providing them in a stack ready for use in for example the serving line.

BRIEF DESCRIPTION OF THE DRAWINGS

The novel features and operation of the present invention will be better understood by reference to the drawings, in conjunction with reading the following specification, in which.

DETAILED DESCRIPTION OF THE INVENTION AND THE PREFERRED EMBODIMENTS

Figure 1:
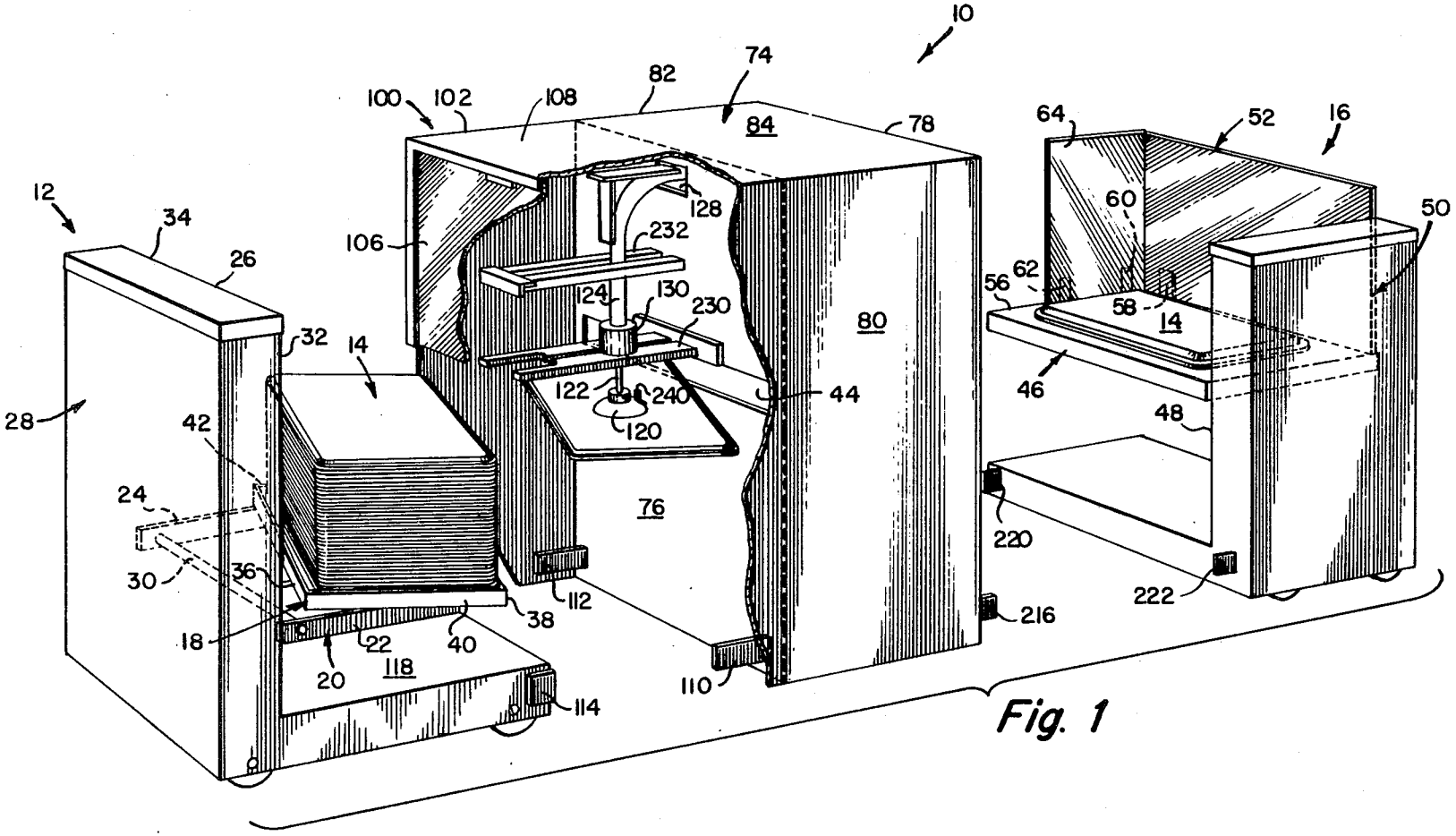
FIG. 1 is a view in perspective showing the preferred embodiment of the invention, in which apparatus are provided in combination with the drying apparatus for feeding wet trays to the drying apparatus from a stack thereof and for collecting and stacking dry trays.

Referring now to the drawing there is shown in FIG. 1 thereof, in operative association, a tray dryer, 10, a self leveling cart 12 from which conventional rectangular shaped serving trays 14, wet from being washed, are fed into the dryer 10 for drying, and a self leveling cart 16 onto which serving trays 14, now dry, are discharged, for use in, for example, the food serving line of the cafeteria.

Trays 14, after being washed in usual fashion, are stacked, according to the preferred aspects of the invention, in inverted fashion, i.e., bottom side up, as shown in the drawing, on the platform 18 of the self leveling portable cart 12, a commercially available cart, but most importantly, modified in accordance with one aspect of the invention, to be discussed later. Platform 18 is fixedly mounted on, and is supported in a horizontal plane by bracket means 20 which comprises support members 22, 24 extending outwardly from and perpendicular to the planar front panel 26 of housing 28 of self leveling cart 12, and cross bar 30 lateral to and connecting support members 22, 24. These support members 22, 24 terminate inside housing 28 and are connected to means not shown, and forming no part of the invention, which allows platform 18 to lower, the greater the number (weight) of serving trays placed on the platform, and to progressively rise to a higher level, as trays are removed. In so doing, support members 22, 24 ride up and down in vertically disposed channels or tracks 32, 34 in the front panel 26 of housing 28.

Figure 2:
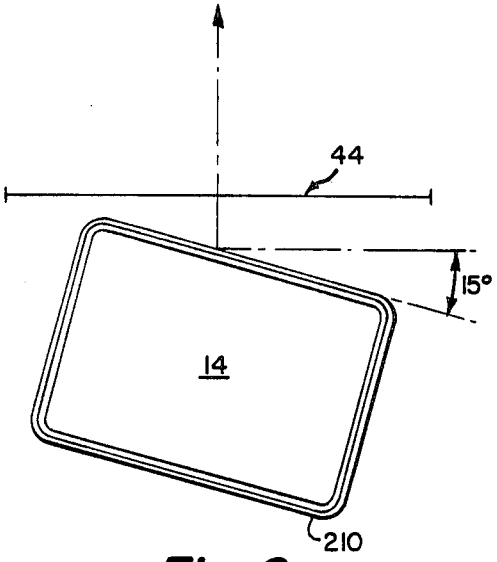
FIG. 2 is a schematic top view showing the path of movement through the dryer and the orientation of the wet feed tray.

The platform 18 of cart 12, as will be appreciated from the drawing, is of a rectangular shape, slightly larger in dimension than rectangular shaped serving trays 14 and is defined by vertically upright parallel side walls 36, 38 and end walls 40, 42 for confinement of the stack of trays 14. Most importantly, however, and this is a surprisingly critical feature of the invention, is the fact that platform 18 is so mounted on bracket means 20 that side wall 38 makes an angle with respect to cross bar 30 of about 15 degrees. Thus, serving trays 14 will be presented to and fed into the rectangular shaped inlet opening 44 of tray dryer 10, one-at-a-time, at an angle less than normal or perpendicular thereto, which has been found necessary to obtain a completly dry serving tray, free of water after having just been washed. Although in the practice of the invention, the serving trays 14 have been so oriented, as to be presented to the dryer opening 44 at an angle less than perpendicular to the path of travel through the dryer, i.e. when the serving tray 14 is oriented as shown in FIG. 2, the leading side edge thereof will make an angle of about 15 degrees relative to the inlet opening 44, this angle can be somewhat greater, if desired, e.g., up to about 75 degrees. The critical consideration is that the serving trays not be so oriented that either their side edges or end edges be lateral to the direction of travel, as this has been discovered not to provide complete drying.

Figure 3:
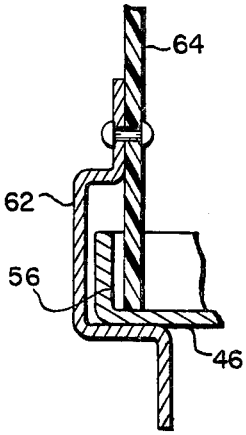
FIG. 3 is a view showing a part of the platform for collecting dry trays and the means for correcting the stacking guide thereto.

On discharge, the serving trays 14, now completely dry, are stacked one-at-a-time, on the horizontally disposed platform 46 of self leveling cart 16. This cart, like cart 12 is commercially available; however, it has been somewhat modified, as hereinafter disclosed, for the purposes of the invention. The cart, as purchased, has the platform 46 disposed in the manner shown in the drawing, i.e., the rectangular shaped platform is perpendicular to the front panel 48 of the housing 50. In accordance with the invention, however, platform 46 is provided with stacking guide 52, the purpose of which will be later more fully explained, if not already obvious. Stacking guide 52 is detachably connected to side wall 54 and end wall 56 by means of spring clamps 58, 60, 62 which easily permit removal of the stacking guide from platform 46, prior to transporting the stack of dry serving trays to the food line for use. Various such clamps can be used so long as they permit easy association with and removal of the stacking guide from the platform 46. As can be seen by reference to FIG. 3 of the drawing, end wall 56 is located outside end member 64 of stacking guide 52, spring clamp 62 contacting the outside of end wall 56 and hooking under the bottom of platform 46.

Figure 4:
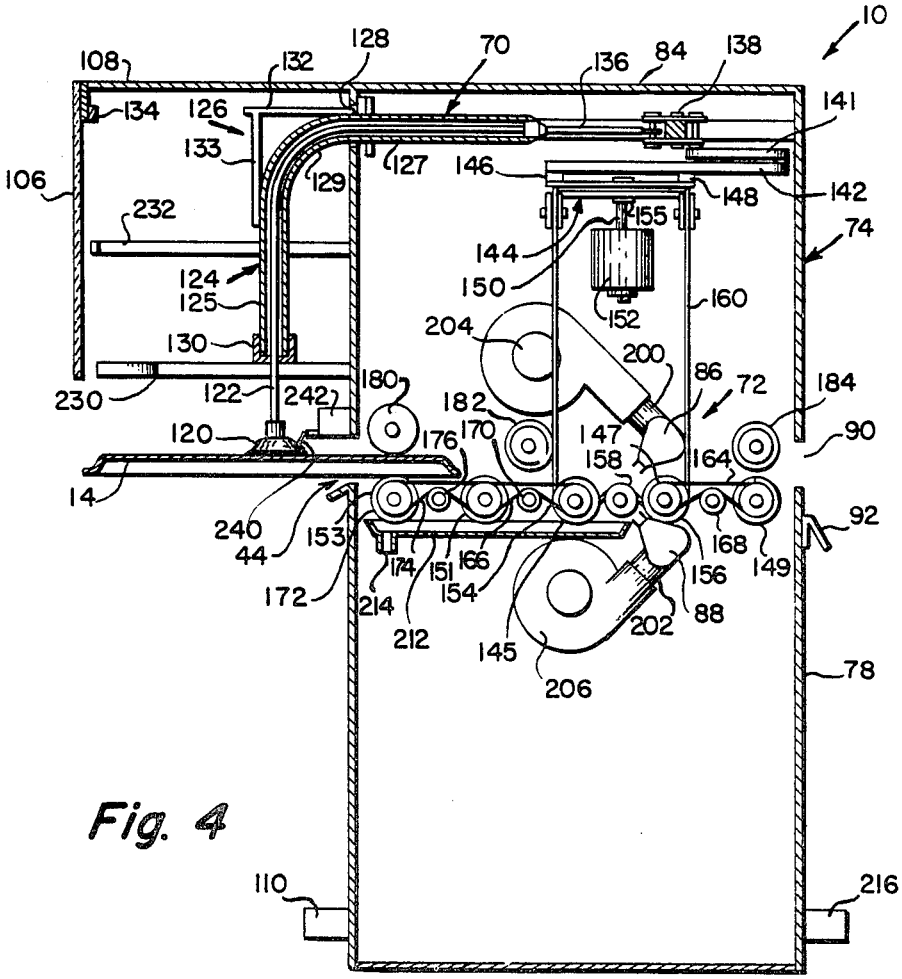
FIG. 4 is a view in cross-section of the drying apparatus and showing the means for feeding the wet serving trays from a stack thereof one-at-a-time to the drying apparatus.
Figure 5:
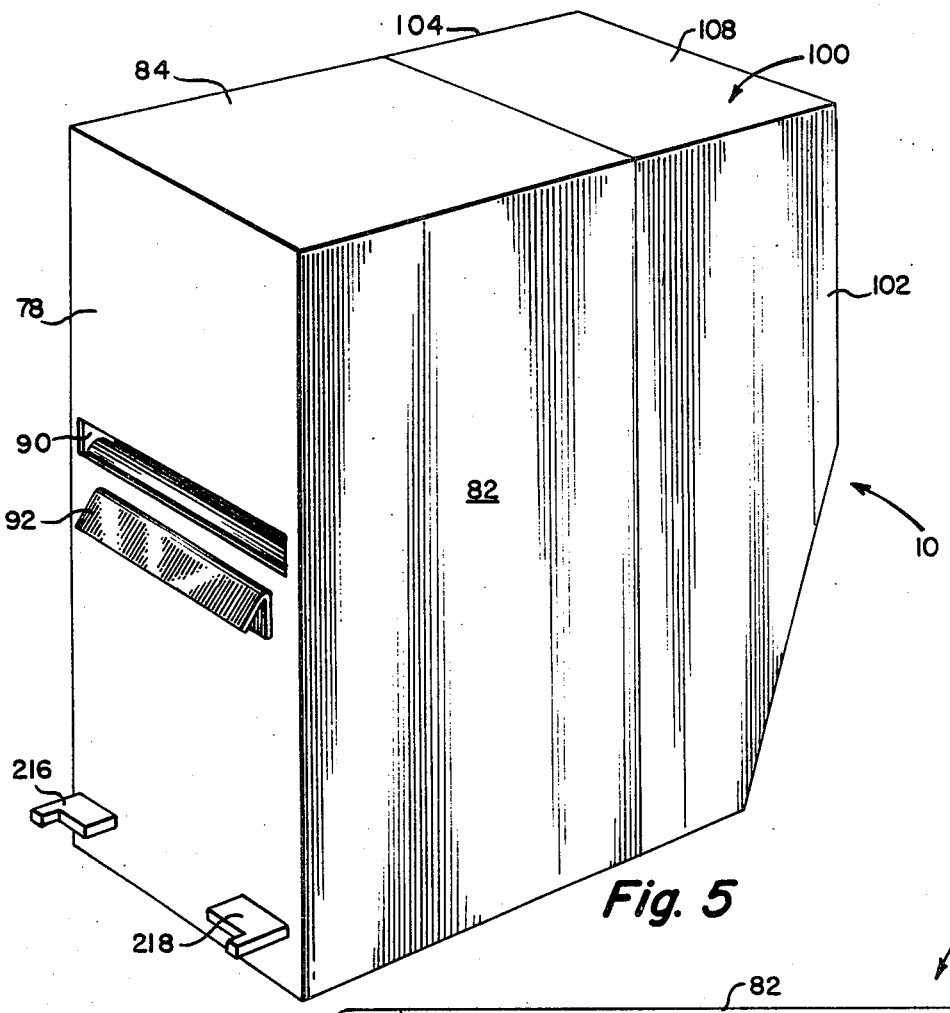
FIG. 5 is a view in perspective of the discharge end of the drying apparatus.

Tray dryer 10, as will be appreciated more fully by reference to FIG. 4 of the drawing, comprises a serving tray feed mechanism denoted in general by reference numeral 70 and a tray conveyor and drying section denoted generally by reference numeral 72 located within housing 74. Housing 74 in general is defined by planar vertically disposed end panels 76, 78 and side panels 80, 82, and a planar horizontally disposed top panel 84, all of which are interconnected at their extremities in usual fashion, to provide a relatively stable and compact unit. One of the side panels in its entirety, or a part thereof, as desired as can the top panel, can be provided readily disconnectable, to provide ready access to the feed mechanism and conveying and drying section for maintenance, as needed. In end panel 76 there is provided as earlier disclosed, rectangular shaped inlet opening 44 through which wet serving trays 14 are fed into the tray dryer 10 for drying. These trays are conveyed, one-at-a-time, between air manifolds 86, 88, later more fully disclosed at which point the tray is dried, top and bottom, by air, and is then discharged from tray dryer 10 through rectangular shaped opening 90 onto platform 46 of self leveling, portable cart 16. The stacking of dry trays 14 will be helped by stack position guide 92, a planar, metal strip, angled downwardly and secured to end panel 78 just below discharge opening 90.

In the most preferred aspect of the invention, as shown in the drawing, there is provided at the inlet end of tray dryer 10, a loading vestibule, or housing denoted generally by reference numeral 100 comprising vertically disposed parallel side members 102, 104 and front member 106, and horizontally disposed top member 108, which side and top members are in alinement with and form essentially a continuous surface with the respective members of tray dryer 10. In the practice of the invention the vestibule members were provided from clear plastic material; however, these members, like the dryer panels can be of white colored plastic material, if desired, or of any other color, as this is of no consequence to the practice of my invention. The dryer panels can be provided from various plastic sheet material, of any color desired, or can be metal, e.g., stainless steel. Front member 106, as shown in FIG. 1 of the drawing terminates at about the vertical location of inlet opening 44 so that self leveling cart 12 can be properly positioned relative to tray dryer 10 for feeding of wet serving trays 14 to the dryer. The proper positioning of cart 12 is determined by position guide members 110, 112 which extend perpendicularly outwardly from end panel 76 of tray dryer 10. Thus, when feeding trays to the dryer, bumpers 114, 116 provided on the front corners of fixed bottom platform 118 of the self leveling cart 12 will be located within position guide members 110, 112, permitting the wet serving trays only to be fed into the inlet opening 44 of the dryer at the proper orientation to the direction of travel, i.e., an angle less than perpendicular thereto.

In operation, a wet serving tray 14 is picked up by suction cup 120 located, as best shown in FIG. 4 of the drawing, at the end of flexible plunger rod 122 which is moveable back and forth within the plunger tube or conduit 124 of the plunger assembly denoted generally by reference numeral 126. Plunger tube 124 which, as can be seen from the drawing, has a vertically disposed section 125 and a horizontally disposed section 127, extending through opening 128 in end panel 76 near its top connected by right angle curved section 129, can be any relatively rigid metal or plastic pipe or tube of suitable size to permit movement as desired, and in accordance with the invention, of the flexible plunger rod. The plunger rod 122 can be any flexible plastic rod suitable for the intended purpose, e.g., a flexible polyvinyl chloride rod, and will extend slightly beyond the conduit 124 at the suction cup end. At the end of the vertically disposed section 125, plunger tube 124 is provided with a bushing 130, the purpose of which will soon be explained. Located on and facing outwardly from curved section 129 of the plunger tube 124, where it curves into opening 128, is provided a horizontally disposed stop member 132, supported by member 133 attached to tube 124, as shown, for contacting limit member 134.

Figure 6:
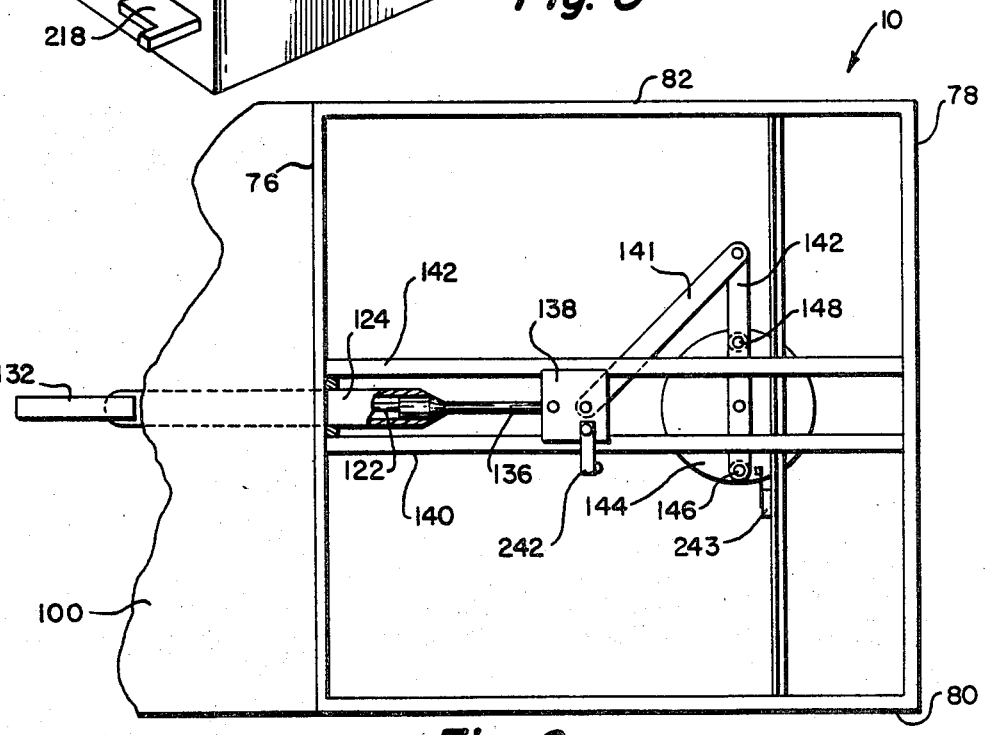
FIG. 6 is a top view looking downwardly into the drying apparatus showing in part the mechanism for feeding a wet serving tray to the dryer.

The other end of flexible plunger rod 122 is connected to drive rod 136 which, in turn, is connected at its other end to drive block 138 which is caused to track back and forth, horizontally, a predetermined distance, in linear direction by parallel guide bars 140, 142 connected at their ends to the end panels 76, 78 of the tray dryer 10. See FIG. 6. Drive block 138 is connected to one end of pivot or drag link 141 which is connected at its other end to pivot drive arm 142, connected in turn and spaced apart from, as shown in the drawing, drive pulley 144 at fixed locations 146, 148. Quite advantageously drive pulley 144 functions not only to drive the block 138 but also, as will be hereinafter more fully disclosed, the driven rolls 145, 147 by means of which the other driven rollers 149, 151 and 153 are powered and serving trays 14 are conveyed through the dryer.

Extending downwardly from drive pulley 144, and connected axially thereto is drive spindle 150 (FIG. 4) connected to a conventional motor 152. Quite advantageously, in accordance with a feature of the invention, when the tray dryer 10 is being operated, it draws less than 15 amps current, permitting the unit to be plugged into the usual electrical outlet without need for hand wiring. Thus, any low horsepower motor can be used provided these electrical requirements are met, such as the 1/12th h.p., gear head motor, 115 v, 2.4 amps. available commercially from Bodine Electric Company. Drive pulley 144 is desirably provided with safety clutch 155, a conventional function type, torque limiting clutch.

As will be seen by reference to FIG. 4, rolls 145, 147 are driven by drive belt 160 which passes around drive pulley 144 and driven pulleys 154, 156 located, respectively, on the end of the axis of rolls 145, 147, according to conventional technique. The tension on the drive belt 160 can be adjusted as needed by appropriate adjustment, as conventionally done, of idler or tension roll 158. In general, drive belt 160 should wrap driven pulleys 154, 156 by more than 90° to provide positive drive as desired. Secondary driven members (not shown) are provided on the axis of rolls 145, 147, adjacent to driven pulleys 154, 156, for the driving of rolls 149 and 151, which latter roll in turn drives roll 153. This is accomplished respectively by drive belts 164, 166, the tension in these drive belts being adjusted through idler rolls 168, 170, respectively. A second driven pulley (not shown) located on the axis of roll 151 is then used to drive pulley 172 (roll 153) by belt 174, the tension in which can be adjusted by adjustment of idler roll 176. These driven rolls, as can be seen from FIG. 4 are arranged serially in the same horizontal plane.

Figure 7:
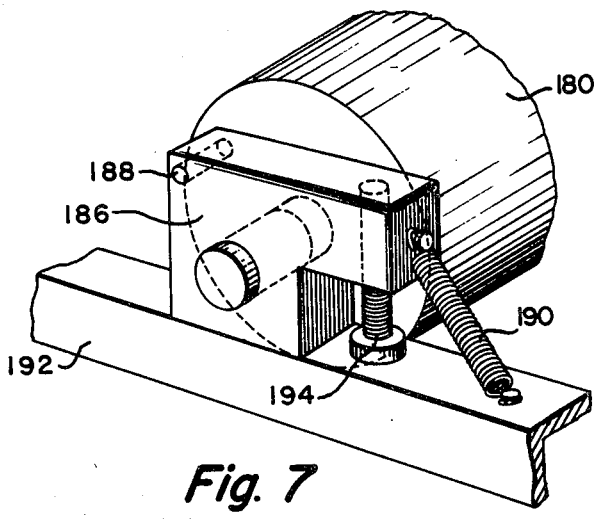
FIG. 7 is a view in perspective taken at one end of one of the idler rolls showing its moveable mounting.
Figure 9:
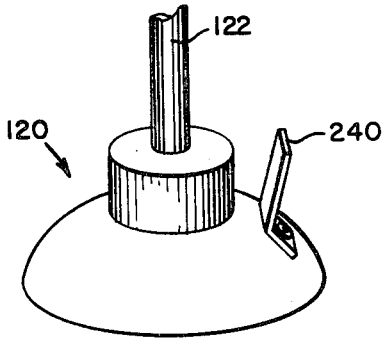
FIG. 9 is a perspective view of a suction cup used in accordance with the invention showing the member in combination therewith for breaking suction with a serving tray on feeding it into the dryer inlet opening.

In opposition to the driven rolls 145, 147, 149, 151, and 153, and providing a nip therewith for engagement of serving tray 14 are provided a plurality of idler rolls 180, 182, 184, located as shown in the drawing. These idler rolls are mounted in the same horizontal plane above that of the driven rolls but are mounted such that the nip between an idler roll and driven roll can be increased as a serving tray 14 passes therebetween. Thus, as shown in FIG. 4, as serving tray 14 passes between rolls 153, 180, the nip therebetween increases. This was accomplished in the practice of this invention by mounting the ends of the idler roll 180 in moveable mounting blocks such as referred to by numeral 186 (FIG. 7) which blocks are supported at pivot point 188 by a horizontally disposed rod (not shown) connected to the dryer apparatus framework. Thus, as the leading edge of a serving tray 14 passes in contact and under an idler roll, the mounting block 186 is caused to pivot counter clockwise against the action of a spring such as denoted by reference numeral 190. When the trailing edge of the tray clears the idler roll, the mounting block returns to its usual location against base support 192, as determined by stop 194. This stop can be a threaded member such as a bolt which can be secured into a threaded bore provided, as indicated in the drawing, in the underside of the mounting block extension arm. Thus, the nip between the driven and idler rolls when no tray is passing therebetween will be determined in part by the location of the pivot rods for mounting blocks 186, and more finely tuned as needed by adjustment of stop 194. Spring 190 will operate to bring the idler roll back to its closed position and to provide the desired pressure of an idler roll against the serving tray 14 being conveyed. It will be appreciated that idler rolls 180, 182, and 184 are all similarly mounted.

One of the idler rolls, preferably idler roll 180, is operatively connected to suitable switch means, (not shown) whereby the system will shut off when wet trays are no longer being conveyed through the dryer. Various delay timer switches can be used for this purpose. In general this switch will be off when idler roll 180 is in its closed nip position, and on when this roll nip is opened by passage of a serving tray. When the trailing edge of a tray clears idler roll 180 and it returns to its relatively closed position, the switch will return to its off position but delay turning off the power to the blowers, hereinafter disclosed, and motor 152 for a set period of time, e.g., ten seconds. Other delay times can be used rather than ten seconds, however, the minimum time will be determihed by the time cycle required for a tray to be picked up from a stack of wet trays, conveyed through the dryer and discharged as a dry tray. Obviously the drying system can be operated without benefit of such an automatic shut-off; however, this is obviously a waste of energy and contributes to the cost of operation.

As will be appreciated, the rolls can be provided of various materials so long as the roll surfaces provide the necessary frictional characteristics and resiliency. Satisfactory rolls will in general be found constructed of metal cylinders about one inch diameter covered with an inner layer of polyurethane or other conventional plastic material used for this purpose and an outer layer of a vinyl plastisol or like composition. However, various other plastic materials can be used, as desired.

Air manifolds 86, 88 as shown, are desirably of triangular cross-section and are disposed in opposition to one another laterally to the direction of travel of serving trays 14 through the dryer 10. These manifolds extend the width of the rolls and are provided intermediate their length with inlet openings 200, 202 for high velocity air from blowers 204, 206, respectively. Various blowers can obviously be used to accomplish the purposes of this invention; however, I have found that satisfactory results will be obtained by blower Model 2500, 120 v. 60A. 60 Hz available commerically from the Weed Eater Div. Emerson Electric Co. Air will be discharged from an elongated slot about $\frac{1}{8}''$–$\frac{1}{4}''$ wide in the base of the manifold which extends laterally across the entire path over which the serving tray is conveyed. Although air manifolds 86, 88 can be of circular shaped cross-section, this is less desired, as the triangular shaped cross-section allows the manifold and the air discharge slots to be placed in close proximity, e.g., $\frac{1}{4}$ inch or less, to wet serving trays 14. This is a necessary and important feature to provide the desired stripping or wiping of the water from the wet tray, as the velocity of the air diminishes rapidly after it leaves the manifold. Moreover, it permits the drying unit to be of somewhat more compact design. Air manifolds 86, 88 are mounted, in dryer 10 such that air is discharged at an angle to the horizontal slightly less than 90°. Thus, as a serving tray 14 is subjected to the high velocity air discharge, water on the serving tray will be pushed back along its bottom and top surfaces toward the trailing edge of the serving tray and that tray will be wiped clean of water. As will be appreciated from reference to FIG. 2 water on the tray is being wiped back along its surfaces to the trailing corner 210, rather than along an entire side or end edge. The water wiped from the serving tray is collected in a somewhat horizontally disposed basin 212 connected to the side and end panels but which slopes slightly downwardly from end panel 78 to end panel 76, and is discharged there from through opening 214, to be collected in a container (not shown) or directly to a sewer.

In the use of the invention, a self leveling cart 16 will be first positioned at the discharge end of the dryer 10, as is shown in FIG. 1 of the drawing. This cart must be so located with respect to the dryer discharge that serving trays will be properly stacked on the platform 46. Accordingly, the side wall of platform 46 must be parallel to end panel 78 and its lateral center line disposed normal to the center line of the serving trays path of travel. The proper positioning will be aided by position guides 216, 218 fixedly located on end panel 78. The bumper 220 will, as shown, conform to position guide 218 and the outwardly extending finger 222 on cart 16 will engage with position guide 216. Thus, as a serving tray is discharged from outlet opening 90, the left hand corners thereof will contact the vertically upright surfaces of the stacking guide 52 causing re-orientation thereof and with aid of position guide 92 stacking of the trays on platform 46 normal to the direction of travel through the dryer.

Next, a stack of wet serving trays 14 located on a self leveling cart 12 are positioned at the feed end of dryer 10 adjacent end panel 76. This positioning is aided by guides 110, 112, as earlier disclosed. Once the carts are properly located, electrical power is turned on to the motor 152 and the air blowers 204, 206. When this occurs, drive pulley 144 operates to cause drive rod 136 to move forward in a linear direction which in turn causes plunger tube 124 to be also moved a predetermined distance until stop 132 contacts limit member 134. Thus, the plunger tube 124 and plunger rod 122 contained therein will have moved in a horizontal direction, to position suction cup 120 over the center point of the top serving tray 14 in the stack of wet trays.

The plunger rod is prevented from moving, except in the horizontal direction, by the plunger rod guide rails 230 until contact is made by stop 132 with limit contact 134. As will be seen from the drawing the plunger rod guide rails 230 provide a track along which plunger rod 122 passes. This track is narrower for a predetermined distance outwardly from panel 76 and then becomes wider, allowing for passage vertically downwardly of bushing 130. At this point, the plunger rod 122 will continue movement but now in a vertical direction downwardly until the top serving tray is contacted by suction cup 120. The movement of plunger tube 124 is prevented by the limit contact 134, the vertical section thereof being guided by upper plunger guide rails 232, the width between which is uniform along their length.

Figure 8A:
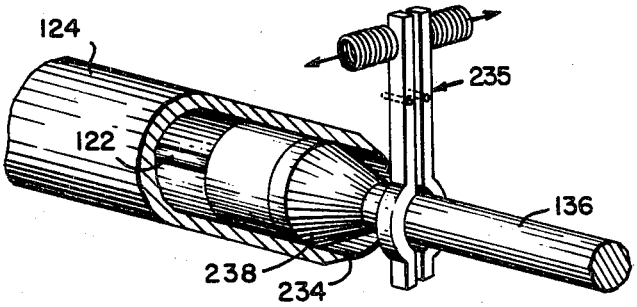
FIG. 8A is a perspective view partly in section showing the operation of the trap preventing movement of the plunger rod tube.
Figure 8B:
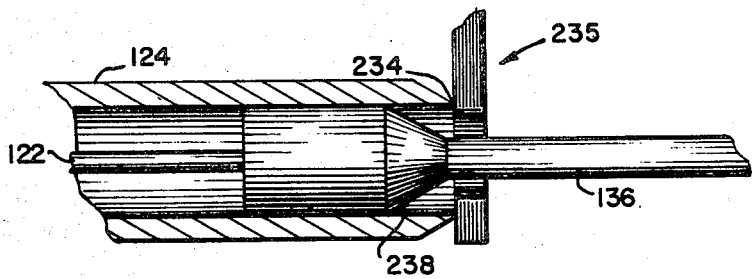
FIG. 8B is a side view in cross-section showing the operation of the trap.

On its backward movement drive rod 136 retracts plunger rod 122 causing the top serving tray 14 to be raised vertically from the stack, suction cup 120 being firmly attached to the back surface of the tray, to a height sufficient to feed the tray into inlet opening 44 of the tray dryer 10. At this point, movement of plunger tube 124 is prevented because on its forward movement its top end 234 (FIG. 8) is trapped behind a spring loaded clamp 235 which when closed forms a circular shaped opening of somewhat lesser diameter than tube 124. On retraction of plunger rod 122, the conical surface 238 of drive rod 136 will bear against the periphery of the circular shaped opening thereof causing it to increase in diameter to allow passage of tube 124. When this occurs, tube 124 will move horizontally and along with it tray 14 into opening 44 until the front corner of the tray is nipped by rolls 180, 153. When member 240 on suction cup 120 contacts block 242, the edge of suction cup 120 will be raised and the suction broken, allowing the tray to freely move into the dryer 10 by the conveying rolls. The plunger rod is retracted until the activator arm 242 on drive block 138 hits a limit switch (not shown) at which time the cycle starts again, with forward movement of the drive block. Although, as shown in FIG. 8, top end 234 is tapered, this will depend somewhat on the particular configuration of clamp 235 and the wall thickness of tube 124. With thinner walled tubing the end can be, in some cases, squared-off, rather than tapered as shown.

The cycle repeats itself until idler roll 180 senses there are no more trays on cart 12 to be fed into the dryer. When this occurs, the cycle will continue for the predetermined delay time before the power to the system is shut off, and drive block 138 is in the retracted position as determined by the limit switch activated by activator arm 242. This is necessary in order that plunger rod 122 is retracted for positioning of a further cart 12 of wet trays in the feed position. Although not disclosed, it will be appreciated that an appropriate fitting can be provided on plunger tube 124 for injecting of lubricant into the tube. This may be necessary from time-to-time to provide good sliding of the plunger rod 122 in the tube. Thus, although not shown in the drawing for sake of clarity, plunger tube 124 will be sealed at both ends in accordance with conventional techniques.

It will be further appreciated that platform 18 and 46 can be provided as part of a self leveling stationary unit, rather than a portable cart, if desired. Or the platform 18 for wet serving trays can be part of a stationary or fixed unit associated with tray dryer 10 and platform 46 be the self leveling platform of a portable cart. Also, the carts 12 and 16 can be modified to provide for serving trays 14 being fed into the dryer 10 with the right corner leading, if desired, rather than the left, as disclosed more fully herein. In still a further aspect of the invention, a conventional, portable self leveling cart can be used as the feed cart, but locating the cart at the appropriate angle to feed the trays into the drying unit as earlier disclosed. In this case it may be necessary to extend the vestibule somewhat to accomplish the desired feeding of serving trays.

It will be appreciated that this invention can be used wherever serving trays may be encountered. Earlier, cafeterias and hospitals, have been disclosed but obviously there are other applications, e.g., airline feeding operations.

It should be understood that the specific embodiments described herein are merely exemplary of the preferred practice of the present invention and that various modifications and changes may be made in the particular embodiments described herein without departing from the spirit and scope of the present invention.

What I claim is:

1. Apparatus for the drying of wet serving trays without benefit of heat comprising in operative combination:

(a) a housing and support for said apparatus defined by vertically disposed spaced-apart first and second parallel end panels, and vertically disposed, spaced-apart first and second parallel side panels interconnected therewith and a horizontally disposed top panel connecting together said side and end panels, a rectangular shaped, horizontally disposed opening in said first end panel whereby said wet serving trays can be fed into said apparatus for drying, and a rectangular shaped, horizontally disposed opening in said second end panel through which dry serving trays are discharged;

(b) means located within said housing and associated with said rectangular shaped openings for conveying the said wet trays horizontally, bottom side up, one-at-a-time through said apparatus in a predetermined path;

(c) means for subjecting the top and bottom of each said wet tray while being so conveyed to high velocity air for wiping the water from the wet tray;

(d) means external to said housing and support for said drying apparatus in association with the horizontally disposed opening in the said second end panel whereby the dry serving trays form a stack as they are discharged one-at-a-time, said means comprising a rectangular shaped self-leveling platform located closely adjacent and normal to the said second end panel for holding said stack of dry trays as it is formed, a detachable stacking guide being provided in combination with said platform to aid in the forming of the stacking of dry serving trays; and (e) means for disposing of the water removed from the wet serving trays.

2. Apparatus for the drying of wet serving trays without benefit of heat according to claim 1 wherein the means for conveying said trays comprises in combination a plurality of driven rolls and idler rolls.

3. Apparatus for the drying of wet serving trays without benefit of heat according to claim 2 wherein five driven rolls are provided in spaced apart locations in the same horizontal plane.

4. Apparatus for the drying of wet serving trays without benefit of heat according to claim 3 wherein three idler rolls are provided in the same horizontal plane above that of the said driven rolls whereby each said tray in being conveyed through the apparatus is contacted in serial fashion on its bottom side by said idler rolls and on its top side by the driven rolls.

5. Apparatus for the drying of wet serving trays without benefit of heat according to claim 4 wherein each said idler roll is individually spring mounted whereby the nip between each said roll and a respective driven roll will be increased as the serving tray passes therebetween while at the same time maintaining a desired pressure against said serving tray.

6. Apparatus for the drying of wet serving trays without benefit of heat according to claim 5 wherein means are provided in association with one pair of the said idler and driven rolls for sensing that no tray is passing therebetween and for inactivating the driving means for the driven rolls.

7. Apparatus for the drying of wet serving trays without benefit of heat according to claim 1 wherein air manifolds are located above and below the said predetermined path along which the serving trays are conveyed and means are provided in association with said air manifolds for providing high velocity air thereto.

8. Apparatus for the drying of wet serving trays without benefit of heat according to claim 7 wherein the said air manifolds each have an elongated slot for discharge of air and said slot is located transversely of the serving tray's direction of travel as it is being conveyed.

9. Apparatus for the drying of wet serving trays without benefit of heat according to claim 8 wherein each said manifold in cross section is of approximately triangular shape enabling the manifolds to be located in close proximity to the tray being conveyed.

10. Apparatus for the drying of wet serving trays without benefit of heat according to claim 1 wherein the means for disposing of the water removed is a collection means comprising a somewhat horizontally disposed sloping surface having a discharge opening therein for discharge of water collected.

11. Apparatus for the drying of wet serving trays without benefit of heat according to claim 1 wherein the said self-leveling platform is the self-leveling platform of a conventional portable self-leveling cart.

12. Apparatus for the drying of wet serving trays without benefit of heat according to claim 11 wherein means are provided on said second end panel for positioning the said cart relative to the said discharge opening.

13. Apparatus for the drying of wet serving trays without benefit of heat according to claim 1 further comprising in combination therewith means for feeding wet serving trays into the rectangular shaped opening in said first end panel at an angle less than normal to the predetermined path of travel.

14. Apparatus for the drying of wet serving trays without benefit of heat according to claim 13 wherein said means for feeding comprises a self-leveling, rectangular-shaped platform disposed at an angle less than normal to the said predetermined path of travel and located closely adjacent to said first end panel.

15. Apparatus for the drying of wet serving trays without benefit of heat according to claim 14 wherein said platform for the feeding means is the self-leveling platform of a portable self-leveling cart and guide means are located on said first end panel for locating the cart and said platform relative to the said rectangular-shaped opening in the first end panel for proper feeding of wet serving trays to the apparatus.

16. Apparatus for the drying of wet serving trays without benefit of heat according to claim 15 wherein said means for feeding said trays further comprises means for picking up trays one-at-a-time from a stack thereof and feeding them one-at-a-time into the apparatus for drying.

17. Apparatus for the drying of wet serving trays without benefit of heat according to claim 16 wherein said means for picking up said trays comprises a suction cup.

18. Apparatus for the drying of wet serving trays without benefit of heat according to claim 17 wherein means are attached to said suction cup for providing movement of the said suction cup in both vertical and horizontal directions as desired.

19. Apparatus for the drying of wet serving trays without benefit of heat according to claim 18 wherein means providing for horizontal movement of the suction cup comprises an inflexible tubular conduit having a vertically disposed section and a horizontally disposed section connected together by a curved right angular section.

20. Apparatus for the drying of wet serving trays without benefit of heat according to claim 18 wherein means providing for said suction cup to move in vertical direction comprises an elongated flexible plunger rod located within said tubular conduit connected at one end to said suction cup and means connected to said other end of the plunger rod for causing it and said tubular conduit to be moved simultaneously together a predetermined distance in a horizontal direction and said plunger rod then to be moved back and forth therein.

21. Apparatus for drying of wet serving trays without benefit of heat according to claim 20 wherein the means for conveying said trays comprises in combination a plurality of driven rolls and idler rolls and a means for driving operatively connected to both said means connected to said other end of the plunger rod and to said driven rolls whereby said plunger rod will be moved back and forth within said tubular conduit for picking up a wet serving tray and feeding it into the drying apparatus and said driven roll will rotate and convey the serving trays through the drying apparatus.

22. Apparatus for dyring of wet serving trays without benefit of heat according to claim 21 wherein the means for driving is a drive pulley mounted in horizontally disposed fashion.

23. Apparatus for drying of wet serving trays without benefit of heat according to claim 22 wherein the means capable of horizontal back and forth linear movement is connected to said means connected to said other end of the plunger rod and said drive pulley is operatively connected to means capable of back and forth movement whereby the rotational movement of the drive pulley causes said means to move back and forth in linear horizontal direction.

24. Apparatus for the drying of wet serving trays without benefit of heat which comprises in combination:

(a) means for conveying said wet trays horizontally, bottom side up, one-at-a-time through said apparatus in a predetermined path;

(b) means for feeding said wet trays into said apparatus whereby the said wet serving trays are presented to said apparatus and conveyed therethrough at an angle less than normal to the said predetermined path of travel;

(c) means disposed closely adjacent above and below said wet trays being conveyed for discharging a linear stream of high velocity air transversely across the direction of travel of the wet serving trays whereby the water on the wet trays will be pushed back along the top and bottom surfaces of the serving tray and the tray will be wiped clean of water; and (d) means located below said conveying means for collecting the water wiped from the trays and for disposing of it.

* * * * *